US008166955B2

(12) United States Patent
Achor

(10) Patent No.: US 8,166,955 B2
(45) Date of Patent: May 1, 2012

(54) FUEL VAPOR SEPARATOR WITH EVAPORATIVE EMISSIONS CHAMBER AND MARINE FUEL SYSTEM AND ENGINE THEREWITH

(75) Inventor: Kyle Achor, Monticello, IN (US)

(73) Assignee: Federal Mogul Corporation, Southfield, MI (US)

( * ) Notice: Subject to any disclaimer, the term of this patent is extended or adjusted under 35 U.S.C. 154(b) by 324 days.

(21) Appl. No.: 12/548,813

(22) Filed: Aug. 27, 2009

(65) Prior Publication Data

US 2011/0048386 A1 Mar. 3, 2011

(51) Int. Cl.
*F02M 37/20* (2006.01)
*F02M 33/02* (2006.01)

(52) U.S. Cl. ..... 123/516; 123/519

(58) Field of Classification Search ..... 123/516, 123/518, 519, 520
See application file for complete search history.

(56) References Cited

U.S. PATENT DOCUMENTS

| | | | | |
|---|---|---|---|---|
| 3,610,221 | A | 10/1971 | Stoltman | |
| 3,683,597 | A * | 8/1972 | Beveridge et al. | 123/519 |
| 4,876,993 | A | 10/1989 | Slattery | |
| 5,355,861 | A | 10/1994 | Arai | |
| 5,389,245 | A | 2/1995 | Jaeger et al. | |
| 5,404,858 | A * | 4/1995 | Kato | 123/516 |
| 5,598,827 | A * | 2/1997 | Kato | 123/518 |
| 6,257,208 | B1 * | 7/2001 | Harvey | 123/516 |
| 6,425,380 | B2 * | 7/2002 | Yamada et al. | 123/519 |
| 6,470,862 | B2 | 10/2002 | Isobe et al. | |
| 6,526,950 | B2 | 3/2003 | Ito et al. | |
| 6,553,974 | B1 * | 4/2003 | Wickman et al. | 123/516 |
| 6,575,145 | B2 * | 6/2003 | Takahashi | 123/519 |
| 6,655,366 | B2 * | 12/2003 | Sakai | 123/518 |
| 6,694,955 | B1 * | 2/2004 | Griffiths et al. | 123/516 |
| 6,718,953 | B1 * | 4/2004 | Torgerud | 123/516 |
| 6,892,710 | B2 * | 5/2005 | Ekstam | 123/514 |
| 6,959,696 | B2 | 11/2005 | Shears et al. | |
| 6,964,268 | B2 * | 11/2005 | Stickel | 123/516 |
| 7,159,577 | B2 | 1/2007 | Haskew et al. | |
| 7,267,112 | B2 * | 9/2007 | Donahue et al. | 123/518 |
| 7,353,809 | B2 * | 4/2008 | Peterson et al. | 123/516 |
| 7,380,543 | B2 * | 6/2008 | Hatano et al. | 123/519 |
| 7,431,021 | B1 | 10/2008 | Achor | |
| 7,438,059 | B2 | 10/2008 | Mills et al. | |
| 7,631,635 | B2 * | 12/2009 | Hochstein et al. | 123/516 |
| 7,677,225 | B2 * | 3/2010 | Radue et al. | 123/509 |
| 7,849,837 | B2 * | 12/2010 | Hasebe et al. | 123/516 |
| 7,895,991 | B2 * | 3/2011 | Lin et al. | 123/519 |
| 2005/0022672 | A1 | 2/2005 | Loevenbruck | |
| 2005/0045160 | A1 | 3/2005 | Peterson | |
| 2008/0308073 | A1 | 12/2008 | Allen | |

* cited by examiner

*Primary Examiner* — Thomas Moulis
(74) *Attorney, Agent, or Firm* — Robert L. Stearns; Dickinson Wright, PLLC

(57) ABSTRACT

A unitized fuel vapor separator and evaporative emission device; marine fuel system, and marine engine therewith are provided. The device includes a fuel vapor separator and evaporative emissions chamber having a common wall separating the fuel vapor separator from the evaporative emissions chamber. The fuel vapor separator is configured for fluid communication with an upstream fuel tank and with a fuel pump and has a fuel vapor outlet to channel fuel vapor outwardly therefrom. The evaporative emissions chamber is configured for fluid communication with the fuel tank to receive fuel vapor therefrom and has an adsorption material for adsorbing fuel vapor and dissipating air from the fuel vapor through an air outlet to channel the air outwardly therefrom.

15 Claims, 2 Drawing Sheets

FUEL VAPOR SEPARATOR WITH EVAPORATIVE EMISSIONS CHAMBER AND MARINE FUEL SYSTEM AND ENGINE THEREWITH

BACKGROUND OF THE INVENTION

1. Technical Field

This invention relates generally to fuel systems, and more particularly to marine fuel systems and vapor and evaporative devices therefor.

2. Related Art

In inboard/outboard marine engine applications, an engine is mounted to boat and a separate fuel tank is carried on the boat. A fuel line is configured in fluid communication with the fuel tank and the engine to supply fuel the engine. Typically, the fuel line is connected to an intervening vapor separator, with the fuel line then continuing to directed fuel under high pressure via a fuel pump from the fuel vapor separator to the fuel injection system. In addition, a vapor vent line generally extends from the fuel vapor separator to an air intake of the engine. To relieve vapor pressure from within the fuel tank, a separate vapor vent line typically extends from the fuel tank to vent fuel vapor directly to the atmosphere. Some applications are known to incorporate a separate evaporative emission control tank in fluid communication with the vapor vent line downstream from the fuel tank to capture fuel vapor prior to its being expelled to the atmosphere. In addition, some evaporative emission control tanks, in addition to venting to the atmosphere, have a fuel vapor line configured in direct fluid communication with the engine to burn the fuel vapor.

Although the fuel systems discussed above can be effective in routing fuel and fuel vapor, certain improvements can be made to enhance the overall effectiveness and efficiency of removing fuel vapor from the fuel tank, while at the same time maximizing the running efficiency of the engine.

SUMMARY OF THE INVENTION

A unitized fuel vapor separator and evaporative emission device includes a fuel vapor separator configured for fluid communication with an upstream fuel tank and with a fuel pump and having a fuel vapor outlet to channel fuel vapor outwardly from the fuel vapor separator. The devices further includes an evaporative emissions chamber configured for fluid communication with the fuel tank to receive fuel vapor therefrom and having an adsorption material for adsorbing fuel vapor and dissipating air from the fuel vapor and having an air outlet to channel the air outwardly from the evaporative emissions chamber. The fuel vapor separator and said evaporative emissions chamber have a common wall separating the fuel vapor separator from the evaporative emissions chamber.

In accordance with another aspect of the invention, a marine fuel system is provided. The system includes a fuel tank; a fuel pump; with a fuel vapor separator configured in fluid communication with the fuel tank to receive liquid fuel therefrom and with the fuel pump to pump liquid fuel from the fuel vapor separator downstream to a combustion chamber and having a fuel vapor outlet to channel fuel vapor outwardly from the fuel vapor separator. The system further includes an evaporative emissions chamber configured for vapor communication with the fuel tank via a fuel vapor line to receive fuel vapor from the fuel tank. The evaporative emissions chamber has an adsorption material for adsorbing fuel vapor and dissipating air from the fuel vapor through an air outlet to channel the air outwardly from the evaporative emissions chamber, wherein the fuel vapor separator and the evaporative emissions chamber have a common wall separating the fuel vapor separator from the evaporative emissions chamber.

In accordance with another aspect of the invention, a marine engine is provided. The marine engine has an air intake, a combustion chamber, and a fuel pump in fluid communication with the combustion chamber. Further, the engine has a fuel vapor separator configured in fluid communication with an upstream fuel tank via a fuel line to receive liquid fuel from the fuel tank and in communication with the fuel pump to pump liquid fuel from the fuel vapor separator downstream to the combustion chamber. In addition, the fuel vapor separator has a fuel vapor outlet to channel fuel vapor outwardly from the fuel vapor separator. The engine further includes an evaporative emissions chamber configured for fluid communication with the fuel tank via a fuel vapor line to receive fuel vapor from the fuel tank. The evaporative emissions chamber has an adsorption material for adsorbing fuel vapor and dissipating air from the fuel vapor through an air outlet to channel the air outwardly from the evaporative emissions chamber, wherein the fuel vapor separator and the evaporative emissions chamber have a common wall separating the fuel vapor separator from the evaporative emissions chamber.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
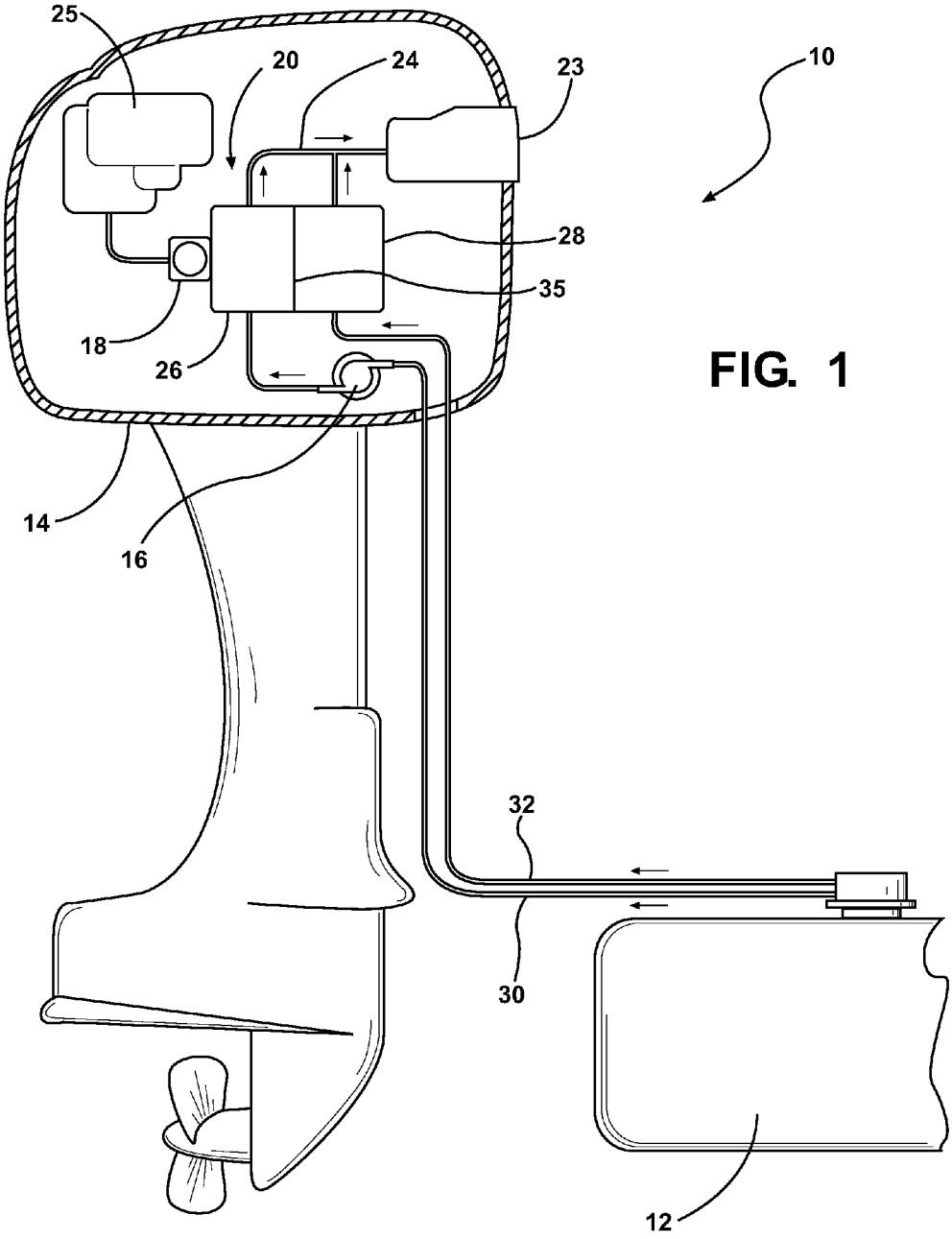
FIG. 1 is a schematic view of a marine fuel system in accordance with one aspect of the invention.

Referring in more detail to the drawings, FIG. 1 illustrates a marine fuel system, referred to hereafter generally as system 10, configured in accordance with one presently preferred embodiment of the invention. The system 10, although shown in an outboard marine engine configuration, can be incorporated into an inboard marine engine configuration as well. The system 10 includes a source of liquid fuel, represented as a separate fuel tank 12 configured removed from and in fluid communication with an engine 14. The liquid fuel is driven by a low pressure lift pump 16 and a high pressure fuel pump 18. The lift pump 16 is responsible for pumping the liquid fuel from the fuel tank 12 to a single component, unitized fuel vapor separator/evaporative emissions device, referred to hereafter as device 20, constructed in accordance with one aspect of the invention. From the unitized device 20, liquid fuel is pumped under high pressure via the fuel pump 18 through a fuel line 22 to one or more combustion chambers 23 and fuel vapor is preferably directed to an air intake 25 of the engine via a fuel vapor line 24. Accordingly, the device 20 is able to perform dual functions including separating fuel vapor from liquid fuel to prevent fuel vapor from being pumped through the high pressure fuel pump 18 and capturing evaporative emissions from the fuel tank 12 via a vapor emissions line 26 for circulation to the air intake of the engine.

The device 20, although constructed as a single component, such as in a molding process, for example, has separate chambers with one chamber being configured as a vapor separator 26 and the other being configured as an evaporative emissions chamber 28. The vapor separator 26 and the evaporative emissions chamber 28, although being constructed as a single component, are bounded as separate containers out of direct fluid communication with one another, such as by an intervening wall 35 that is common to both chambers 26, 28. The vapor separator 26 is in direct fluid communication with the fuel tank 12 via a liquid fuel line 30 and the evaporative emissions chamber 28 is in direct vapor communication with the fuel tank via a vapor line 32. The liquid fuel line 30 and the vapor line 32 are separate and out of communication with one another between the device 20 and the fuel tank 12.

The vapor separator 26 receives liquid fuel from the fuel tank via the fuel line 30. Within the fuel separator 26, fuel vapor rises from the liquid fuel and is channeled to the fuel vapor line 24 via an upstream passage or fuel vapor line 34, while the liquid fuel is pumped to the engine via the fuel pump 18 through the fuel line 22.

The evaporative emissions chamber 28 contains a fuel vapor adsorption material, such as granular charcoal 36. The evaporative emission from the fuel tank 12 is channeled to the chamber 28 via the vapor line 32, wherein the vapor is adsorbed by the charcoal 36, and air separated from the vapor is then allowed to be channeled to the air intake 23 for combustion in the engine 14 through the fuel vapor line 24 via an upstream evaporative emission vapor line 38.

In constructing the device 20, a single process can be used, such as molding, to substantially form the fuel separator 26 and emissions chamber 28. For example, the device 20 can be molded having a common peripheral outer wall 40 extending about the fuel separator 26 and the emissions chamber 28, with the inventing wall 35 being molded to separate the adjacent chambers. The outer wall 40 is preferably formed of a single piece of "as molded" material. It should be recognized that the intervening wall 35 can be formed separately and attached between the outer wall 40, if desired. A lid or cover 42 can then be formed and attached in sealed abutment with an upper surface of the outer and intervening walls 40, 35 to isolate the separate chambers 26, 28 from direct fluid communication with one another. Of course, the openings accommodating the fuel line 30, vapor line 32, vapor line 34 and emission line 38 can be formed in the respective walls, as desired. In addition, a liquid fuel flow passage 44 is provided to bring the fuel vapor separator 26 into fluid communication with the fuel pump 18 so that the fuel pump 18 can receive and pump the liquid fuel to the engine under high pressure. The fuel pump 18 is illustrated as being external to the fuel vapor separator 26, wherein at least a portion of a wall 46 of the fuel pump 18 can be attached and/or formed as one piece of material with the outer wall 40 of the device 20, such as in the aforementioned molding process. Although illustrated being external, the fuel pump 18 can be internal to the fuel vapor separator 26 as well.

Figure 3:
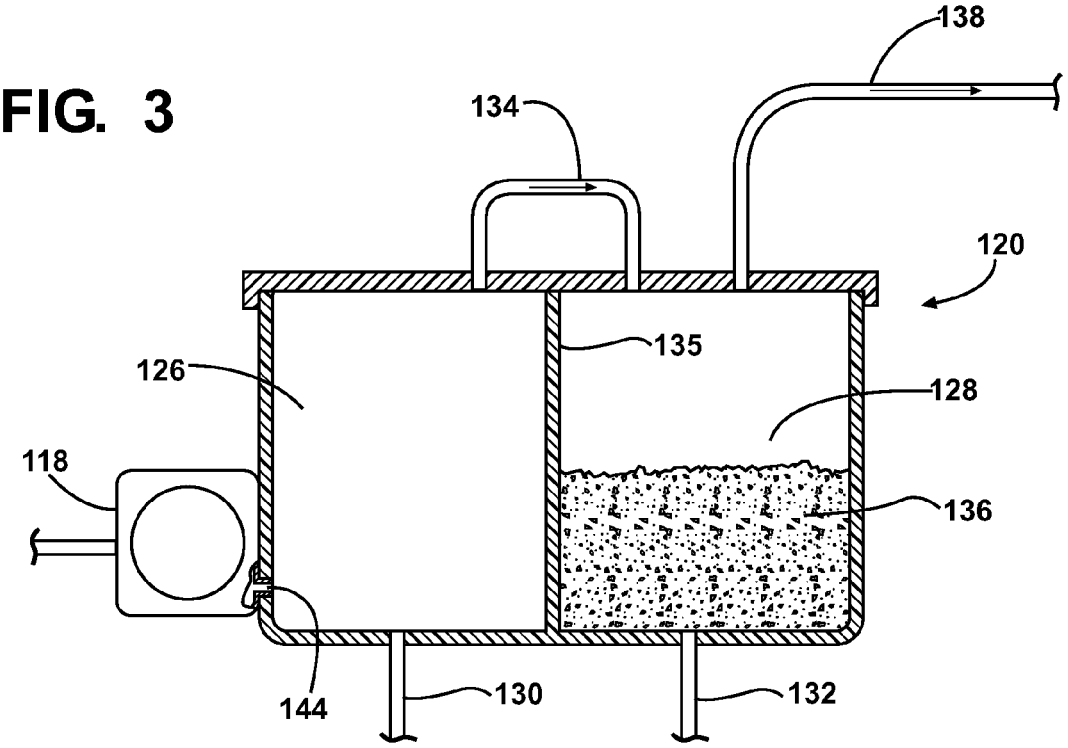
FIG. 3 is a an enlarged schematic view of a vapor separator/evaporative emissions device constructed in accordance with another presently preferred aspect of the invention.

In FIG. 3, a device 120 constructed in accordance with another presently preferred aspect of the invention is shown, wherein the same reference numerals, offset by a factor of 100, are used to identify like features. The device 120 is constructed similarly to the device 20, having a vapor separator 126 and an evaporative emissions chamber 128 separated from one another via an intermediate, intervening wall 135 with respective fuel and vapor lines 130, 132 extending from a fuel tank to channel liquid fuel and fuel vapor from the fuel tank to the vapor separator 126 and evaporative emission chamber 128, respectively. A fuel pump 118 is configured in fluid communication with the vapor separator 126 via a liquid fuel flow passage 144 so that the fuel pump 118 can receive liquid fuel from the vapor separator 126 and pump the liquid fuel to the engine directly from the separator 126. In addition, a passage or fuel vapor line 134 extends from the fuel vapor separator 126 to channel fuel vapor in unidirectional fashion therefrom, however, rather than the fuel vapor line 134 being configured in direct fluid communication with an air intake of the engine, it is configured in direct fluid communication with the evaporative emissions chamber 128. As such, the fuel vapor flows outwardly from the fuel vapor separator 126, preferably from an upper most outlet in a cover 142 thereof, directly to the evaporative emissions chamber 128 having an adsorptive material 136 therein.

Figure 2:
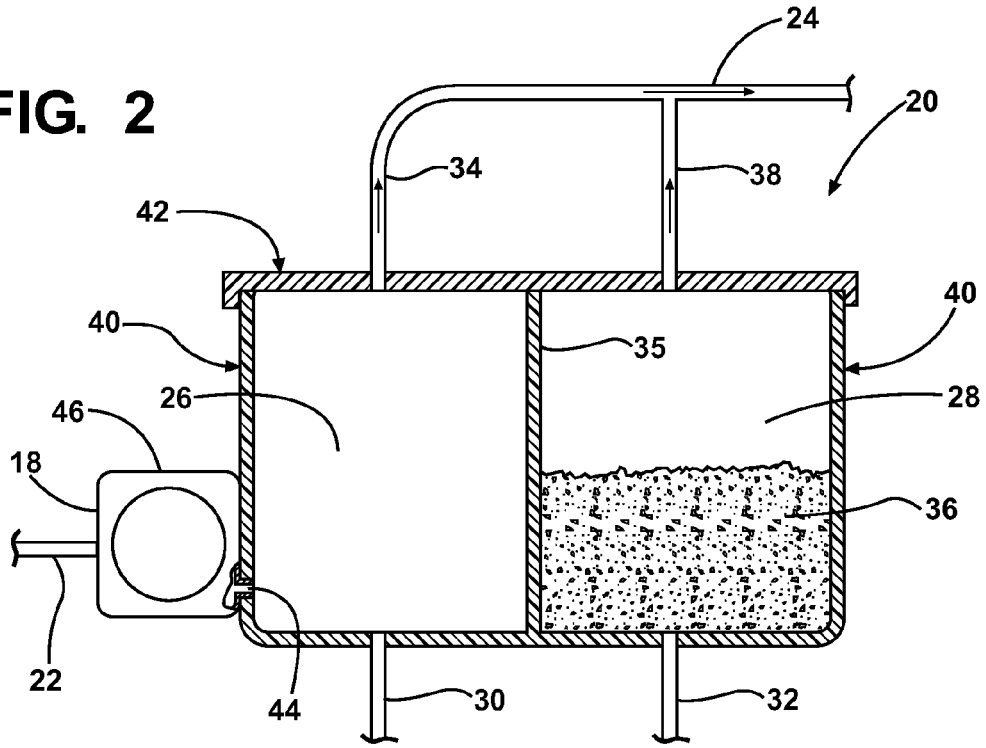
FIG. 2 is a an enlarged schematic view of a vapor separator/evaporative emissions device of FIG. 1.

The evaporative emissions chamber 128 has an emissions line 138 extending therefrom to route filtered air outwardly from the chamber 128. The filtered air comprises air from both the filtered vapor from the vapor separator 126 and air from the filtered evaporative emissions from the fuel tank routed through the evaporative emissions chamber 128. Accordingly, rather than having two filtered air lines as in the device 20 of FIG. 2, the single filter air line 138 communicates the filtered vapor of the vapor separator 126 and the evaporative emission chamber 128 to the desired location, whether directly to the atmosphere or to an air intake of the engine. Given the fuel vapors have been filtered by the adsorptive material 136 in the emissions chamber 128, the resulting air flowing outwardly from the emissions chambers 128 is able to be channeled directly to the atmosphere, if desired.

Obviously, many modifications and variations of the present invention are possible in light of the above teachings. It is, therefore, to be understood that within the scope of the appended claims, the invention may be practiced otherwise than as specifically described.

What is claimed is:

1. A unitized fuel vapor separator and evaporative emission device, comprising:

a fuel vapor separator configured for fluid communication with an upstream fuel tank via a liquid fuel line and with a fuel pump and having a fuel vapor outlet to channel fuel vapor outwardly from said fuel vapor separator;

an evaporative emissions chamber configured for fluid communication with the fuel tank via a fuel vapor line to receive fuel vapor therefrom and having an adsorption material for adsorbing fuel vapor and dissipating air from the fuel vapor and having an air outlet to channel the air outwardly from said evaporative emissions chamber;

wherein the liquid fuel line and the fuel vapor line are separate and out of communication with one another between the fuel tank and the fuel vapor separator and the evaporative emissions chamber; and wherein said fuel vapor separator and said evaporative emissions chamber have a common wall separating said fuel vapor separator from said evaporative emissions chamber as separate containers out of direct fluid communication with one another.

2. The device of claim 1 further comprising a fuel vapor passage extending out from the fuel vapor separator in direct fluid communication with the evaporative emissions chamber to channel fuel vapor from said fuel vapor separator to said evaporative emissions chamber, and wherein the fuel vapor passage extending out from the fuel vapor separator extends around the common wall.

3. The device of claim 2 wherein said adsorption material adsorbs fuel vapor from the fuel vapor separator along with fuel vapor from the fuel tank.

4. The device of claim 3 wherein said air outlet expels air from the filtered fuel vapor from the fuel vapor separator and the fuel tank.

5. The device of claim 1 wherein said fuel vapor separator and said evaporative emissions chamber have a common peripheral outer wall.

6. The device of claim 5 wherein said outer wall is a single piece of material "as molded".

7. A marine fuel system, comprising:

a fuel tank;

a fuel pump;

a fuel vapor separator configured in fluid communication with said fuel tank to receive liquid fuel therefrom via a liquid fuel line and with said fuel pump to pump liquid fuel from said fuel vapor separator downstream to a combustion chamber and having a fuel vapor outlet to channel fuel vapor outwardly from said fuel vapor separator;

an evaporative emissions chamber configured in fluid communication with said fuel tank via a fuel vapor line to receive fuel vapor from said fuel tank and having an adsorption material for adsorbing fuel vapor and dissipating air from the fuel vapor and having an air outlet to channel the air outwardly from said evaporative emissions chamber;

wherein the liquid fuel line and the fuel vapor line are separate and out of communication with one another between the fuel tank and the fuel vapor separator and the evaporative emissions chamber; and wherein said fuel vapor separator and said evaporative emissions chamber have a common wall separating said fuel vapor separator from said evaporative emissions chamber as separate containers out of direct fluid communication with one another.

8. The marine fuel system of claim 7 further comprising a fuel vapor passage extending out from the fuel vapor separator in direct fluid communication with the evaporative emissions chamber to channel fuel vapor from said fuel vapor separator to said evaporative emissions chamber, and wherein the fuel vapor passage extending out from the fuel vapor separator extends around the common wall.

9. The marine fuel system of claim 8 wherein said adsorption material adsorbs fuel vapor from the fuel vapor separator along with fuel vapor from the fuel tank and wherein said air outlet expels air from the filtered fuel vapor from the fuel vapor separator and the fuel tank.

10. The marine fuel system of claim 7 wherein said fuel vapor separator and said evaporative emissions chamber have a common peripheral outer wall.

11. A marine engine, comprising:

an air intake;

a combustion chamber;

a fuel pump in fluid communication with said combustion chamber;

a fuel vapor separator configured in fluid communication with an upstream fuel tank via a liquid fuel line to receive liquid fuel from the fuel tank and with said fuel pump to pump liquid fuel from said fuel vapor separator downstream to said combustion chamber and having a fuel vapor outlet to channel fuel vapor outwardly from said fuel vapor separator;

an evaporative emissions chamber configured for fluid communication with the fuel tank via a fuel vapor line to receive fuel vapor from the fuel tank and having an adsorption material for adsorbing fuel vapor and to dissipate air from the fuel vapor and having an air outlet to channel the air outwardly from said evaporative emissions chamber;

wherein the liquid fuel line and the fuel vapor line are separate and out of communication with one another between the fuel tank and the fuel vapor separator and the evaporative emissions chamber; and wherein said fuel vapor separator and said evaporative emissions chamber have a common wall separating said fuel vapor separator from said evaporative emissions chamber as separate containers out of direct fluid communication with one another.

12. The marine engine of claim 11 further comprising a fuel vapor passage extending out from the fuel vapor separator in direct fluid communication with the evaporative emissions chamber to channel fuel vapor from said fuel vapor separator to said evaporative emissions chamber, and wherein the fuel vapor passage extending out from the fuel vapor separator extends around the common wall.

13. The device of claim 12 wherein said adsorption material adsorbs fuel vapor from the fuel vapor separator along with fuel vapor from the fuel tank.

14. The device of claim 13 wherein said air outlet expels air from the filtered fuel vapor from the fuel vapor separator and the fuel tank to said air intake.

15. The device of claim 11 wherein said fuel vapor separator and said evaporative emissions chamber have a common peripheral outer wall.

* * * * *